US011096545B2

(12) United States Patent
Jang et al.

(10) Patent No.: US 11,096,545 B2
(45) Date of Patent: Aug. 24, 2021

(54) ROBOT CLEANER

(71) Applicant: LG ELECTRONICS INC., Seoul (KR)

(72) Inventors: Jaewon Jang, Seoul (KR); Minwoo Lee, Seoul (KR); Jeongseop Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 331 days.

(21) Appl. No.: 16/057,448

(22) Filed: Aug. 7, 2018

(65) Prior Publication Data

US 2019/0038107 A1 Feb. 7, 2019

(30) Foreign Application Priority Data

Aug. 7, 2017 (KR) ..... 10-2017-0099756

(51) Int. Cl.

| | |
|---|---|
| ***A47L 11/40*** | (2006.01) |
| ***A47L 9/28*** | (2006.01) |
| ***A47L 11/282*** | (2006.01) |
| ***A47L 9/00*** | (2006.01) |

(52) U.S. Cl.

CPC ..... *A47L 11/4061* (2013.01); *A47L 9/009* (2013.01); *A47L 9/2805* (2013.01); *A47L 11/282* (2013.01); *A47L 11/4044* (2013.01); *A47L 2201/04* (2013.01)

(58) Field of Classification Search

CPC ..... A47L 11/4061; A47L 9/2805; A47L 11/4044; A47L 11/282; A47L 9/009; A47L 2201/04; A47L 11/4038; A47L 11/4066; A47L 9/0477; A47L 9/28

See application file for complete search history.

(56) References Cited

U.S. PATENT DOCUMENTS

| | | | |
|---|---|---|---|
| 2,988,762 | A | 6/1961 | Babcock |
| 5,421,053 | A | 6/1995 | Chodak |
| 5,716,730 | A | 2/1998 | Deguchi |
| 5,998,953 | A | 12/1999 | Nakamura et al. |
| 6,012,618 | A | 1/2000 | Matsuo |
| 8,898,844 | B1 | 12/2014 | Dooley et al. |

(Continued)

FOREIGN PATENT DOCUMENTS

| | | |
|---|---|---|
| CN | 1320409 | 11/2001 |
| CN | 1575724 | 2/2005 |

(Continued)

OTHER PUBLICATIONS

United States Office Action dated Jun. 17, 2020 issued in co-pending U.S. Appl. No. 16/057,550.

(Continued)

*Primary Examiner* — David Redding

(74) *Attorney, Agent, or Firm* — KED & Associates, LLP

(57) ABSTRACT

The present application relates to a robot cleaner. The robot cleaner of the present application includes: a main body which forms an external shape; a moving mechanism which moves the main body; a bumper which is positioned to protrude from an outer periphery of the main body; an impact sensor which is positioned obliquely in the main body to detect movement of the bumper; and a pressing unit having a curved end portion which presses the impact sensor, when the bumper moves.

19 Claims, 13 Drawing Sheets

(56) References Cited

U.S. PATENT DOCUMENTS

| | | | |
|---|---|---|---|
| 2004/0143927 | A1 | 7/2004 | Haegermarck et al. |
| 2004/0181896 | A1 | 9/2004 | Egawa et al. |
| 2005/0015913 | A1 | 1/2005 | Kim et al. |
| 2005/0166356 | A1 | 8/2005 | Uehigashi |
| 2006/0185690 | A1 | 8/2006 | Song et al. |
| 2007/0051757 | A1 | 3/2007 | Lim et al. |
| 2007/0061040 | A1 | 3/2007 | Augenbraun et al. |
| 2008/0276407 | A1 | 11/2008 | Schnittman et al. |
| 2009/0064447 | A1 | 3/2009 | Oh et al. |
| 2010/0251497 | A1 | 10/2010 | Arnold |
| 2011/0202175 | A1 | 8/2011 | Romanov et al. |
| 2012/0079670 | A1 | 4/2012 | Yoon et al. |
| 2012/0168971 | A1 | 7/2012 | Hansen et al. |
| 2012/0169497 | A1 | 7/2012 | Schnittman et al. |
| 2012/0222706 | A1 | 9/2012 | Pears et al. |
| 2014/0196247 | A1 | 7/2014 | Kasper |
| 2014/0259478 | A1 | 9/2014 | Conrad |
| 2015/0143646 | A1 | 5/2015 | Jeong et al. |
| 2015/0182090 | A1 | 7/2015 | Park et al. |
| 2015/0223653 | A1 | 8/2015 | Kim et al. |
| 2016/0150934 | A1 | 6/2016 | Kim et al. |
| 2016/0214260 | A1* | 7/2016 | Lee ..... B25J 11/0085 |
| 2016/0331112 | A1 | 11/2016 | Goff |
| 2016/0353960 | A1 | 12/2016 | Dooley et al. |
| 2017/0143175 | A1 | 5/2017 | Kim et al. |
| 2017/0147000 | A1 | 5/2017 | Hoennige et al. |
| 2017/0181591 | A1* | 6/2017 | Tanaka ..... A47L 9/009 |
| 2017/0296021 | A1 | 10/2017 | Li et al. |
| 2018/0242810 | A1 | 8/2018 | Jang et al. |
| 2019/0290089 | A1 | 9/2019 | Johnson et al. |

FOREIGN PATENT DOCUMENTS

| | | |
|---|---|---|
| CN | 1823677 | 8/2006 |
| CN | 102292973 | 12/2011 |
| CN | 103899160 | 7/2014 |
| CN | 204581160 | 8/2015 |
| CN | 104918529 | 9/2015 |
| CN | 106510556 | 3/2017 |
| CN | 106725135 | 5/2017 |
| EP | 1 695 652 | 8/2006 |
| EP | 1 762 165 | 3/2007 |
| EP | 2 327 347 | 6/2011 |
| EP | 2 438 843 | 4/2012 |
| EP | 2 875 768 | 5/2015 |
| EP | 3 138 459 | 3/2017 |
| JP | S45-013591 | 6/1970 |
| JP | S49-65061 | 6/1974 |
| JP | S57-037431 | 3/1982 |
| JP | S63-168142 | 7/1988 |
| JP | JP S63-200731 | 8/1988 |
| JP | H07-009245 | 2/1995 |
| JP | H09-017404 | 1/1997 |
| JP | H09-324875 | 12/1997 |
| JP | H10-211132 | 8/1998 |
| JP | H10-243066 | 9/1998 |
| JP | 2001-249734 | 9/2001 |
| JP | 2002-065538 | 3/2002 |
| JP | 2003-320322 | 11/2003 |
| JP | 2004-166968 | 6/2004 |
| JP | 2005-040578 | 2/2005 |
| JP | 2005-211368 | 8/2005 |
| JP | 2005-211426 | 8/2005 |
| JP | 2005-312702 | 11/2005 |
| JP | 2006-231028 | 9/2006 |
| JP | 2009-509220 | 3/2009 |
| JP | 4278591 | 6/2009 |
| JP | 2009-178345 | 8/2009 |
| JP | 2014-014455 | 1/2014 |
| JP | 2014-137694 | 7/2014 |
| JP | 2015-163153 | 9/2015 |
| KR | 20-1988-0011603 | 8/1998 |
| KR | 10-0241620 | 4/2000 |
| KR | 10-2005-0012047 | 1/2005 |
| KR | 20-0395016 | 9/2005 |
| KR | 10-0661339 | 12/2006 |
| KR | 10-2007-0101432 | 10/2007 |
| KR | 20-0437646 | 12/2007 |
| KR | 10-0814507 | 3/2008 |
| KR | 10-2008-0040761 | 5/2008 |
| KR | 10-0835968 | 6/2008 |
| KR | 10-0848568 | 7/2008 |
| KR | 10-2008-0081626 | 9/2008 |
| KR | 10-0871114 | 11/2008 |
| KR | 10-2010-0076134 | 7/2010 |
| KR | 10-1026003 | 3/2011 |
| KR | 20-0458863 | 3/2012 |
| KR | 10-2012-0069845 | 6/2012 |
| KR | 10-1152720 | 6/2012 |
| KR | 10-1164291 | 7/2012 |
| KR | 10-2012-0129185 | 11/2012 |
| KR | 10-1323597 | 11/2013 |
| KR | 10-1338143 | 12/2013 |
| KR | 10-2014-0011216 | 1/2014 |
| KR | 10-1369220 | 3/2014 |
| KR | 10-2014-0060450 | 5/2014 |
| KR | 10-1487778 | 1/2015 |
| KR | 10-2015-0014351 | 2/2015 |
| KR | 10-1495866 | 2/2015 |
| KR | 10-2015-0057959 | 5/2015 |
| KR | 10-1519685 | 5/2015 |
| KR | 10-2015-0073726 | 7/2015 |
| KR | 10-2015-0078094 | 7/2015 |
| KR | 10-2015-0095469 | 8/2015 |
| KR | 10-1543490 | 8/2015 |
| KR | 10-1544667 | 8/2015 |
| KR | 10-2015-0107398 | 9/2015 |
| KR | 10-2015-0139111 | 12/2015 |
| KR | 10-1578879 | 12/2015 |
| KR | 10-2016-0003435 | 1/2016 |
| KR | 10-1602790 | 3/2016 |
| KR | 10-1622740 | 5/2016 |
| KR | 10-2016-0090567 | 8/2016 |
| KR | 10-2016-0090571 | 8/2016 |
| KR | 10-2016-0097085 | 8/2016 |
| KR | 10-1654014 | 9/2016 |
| KR | 10-1678443 | 12/2016 |
| KR | 10-2017-0049532 | 5/2017 |
| KR | 10-2017-0124216 | 11/2017 |
| KR | 10-2018-0008250 | 1/2018 |
| KR | 10-2018-0025795 | 3/2018 |
| WO | WO 2005/011461 | 2/2005 |
| WO | WO 2015/186944 | 12/2015 |
| WO | WO 2016/036183 | 3/2016 |

OTHER PUBLICATIONS

United States Office Action dated Oct. 21, 2020 issued in U.S. Appl. No. 16/057,076.

European Search Report dated Nov. 16, 2018 issued in EP Application No. 18187634.3.

Korean Office Action dated Jan. 22, 2019 issued in KR Application No. 10-2017-0099763.

United States Office Action dated Apr. 24, 2020 issued in U.S. Appl. No. 16/057,492.

U.S. Appl. No. 16/057,394, filed Aug. 7, 2018.

U.S. Appl. No. 16/057,572, filed Aug. 7, 2018.

European Search Report dated Nov. 14, 2018 issued in EP Application No. 18187619.4.

European Search Report dated Nov. 14, 2018 issued in EP Application No. 18187630.1.

Korean Office Action dated Nov. 20, 2018 issued in KR Application No. 10-2017-0099752.

United States Notice of Allowance dated May 11, 2020 issued in U.S. Appl. No. 16/057,572.

U.S. Appl. No. 16/057,492, filed Aug. 7, 2018.

U.S. Appl. No. 16/056,971, filed Aug. 7, 2018.

Chinese Office Action (with English translation) dated Dec. 21, 2020 issued in CN Application No. 201880065247.8.

The Chinese Office Action dated Dec. 28, 2020.

U.S. Appl. No. 16/057,448, filed Aug. 7, 2018.

(56) References Cited

OTHER PUBLICATIONS

U.S. Appl. No. 17/207,371, filed Mar. 19, 2021.
U.S. Appl. No. 16/256,435, filed Jan. 24, 2019.
U.S. Appl. No. 16/057,516, filed Aug. 7, 2018.
U.S. Appl. No. 16/057,076, filed Aug. 7, 2018.
U.S. Appl. No. 17/180,495, filed Feb. 19, 2021.
U.S. Appl. No. 16/057,550, filed Aug. 7, 2018.
United States Office Action dated Feb. 9, 2021 issued in U.S. Appl. No. 16/057,516.
Chinese Office Action (with English translation) dated Dec. 28, 2020 issued in CN Application No. 201880065371.4.
International Search Report dated May 22, 2019 issued in PCT/KR2019/001021.
European Search Report dated Mar. 29, 2021 issued in EP Application No. 18844052.3.
Chinese Office Action (with English translation) dated Mar. 9, 2021 issued in CN Application No. 201880065253.3.
Japanese Office Action dated Mar. 23, 2021 issued in JP Application No. 2020-507000.
European Search Report dated Mar. 26, 2021 issued in EP Application No. 18842946.8.
European Search Report dated Apr. 9, 2021 issued in EP Application No. 18843690.1.
European Search Report dated Apr. 12, 2021 issued in EP Application No. 18844056.4.

* cited by examiner

ROBOT CLEANER

CROSS-REFERENCE TO RELATED APPLICATION

This application claims priority under 35 U.S.C. § 119 to Korean Application No. 10-2017-0099756 filed on Aug. 7, 2017, whose entire disclosure is hereby incorporated by reference.

BACKGROUND

1. Field

The present application relates to a robot cleaner, and more particularly, to a robot cleaner that cushions an impact using a bumper.

2. Background

The use of robots in the home has been gradually expanding. An example of such a household robot is a cleaning robot (also referred to as an autonomous cleaner). The cleaning robot is a mobile robot that may autonomously travel in a region and can automatically clean a space while traveling. For example, the cleaning robot may suction foreign substances, such as dust, accumulated on a floor, or may perform mopping of the floor using a rotation mop. The cleaning robot having the rotation mop may also move based on a rotation of the rotation mop.

A household robot, such as the cleaning mobile robot, may be impacted by a structure inside the house or other obstacles, and may include a bumper structure to cushion the impact. In some examples, the internal structure of the bumper may include an impact sensor to detect an impact. The impact sensor is generally configured to detect an impact in a particular direction.

Since a single impact sensor may be positioned in a direction to detect impacts for that direction, detecting impacts in multiple directions may generally include positioning a correspond quantity of the impact sensors. When the number of directions that requires impact detection is large, the number of impact sensors is increased proportionally, which increases the size and the cost of a structure for the robot cleaner.

BRIEF DESCRIPTION OF THE DRAWINGS

Embodiments will be described in detail with reference to the following drawings in which like reference numerals refer to like elements, and wherein.

DETAILED DESCRIPTION

Figure 1:
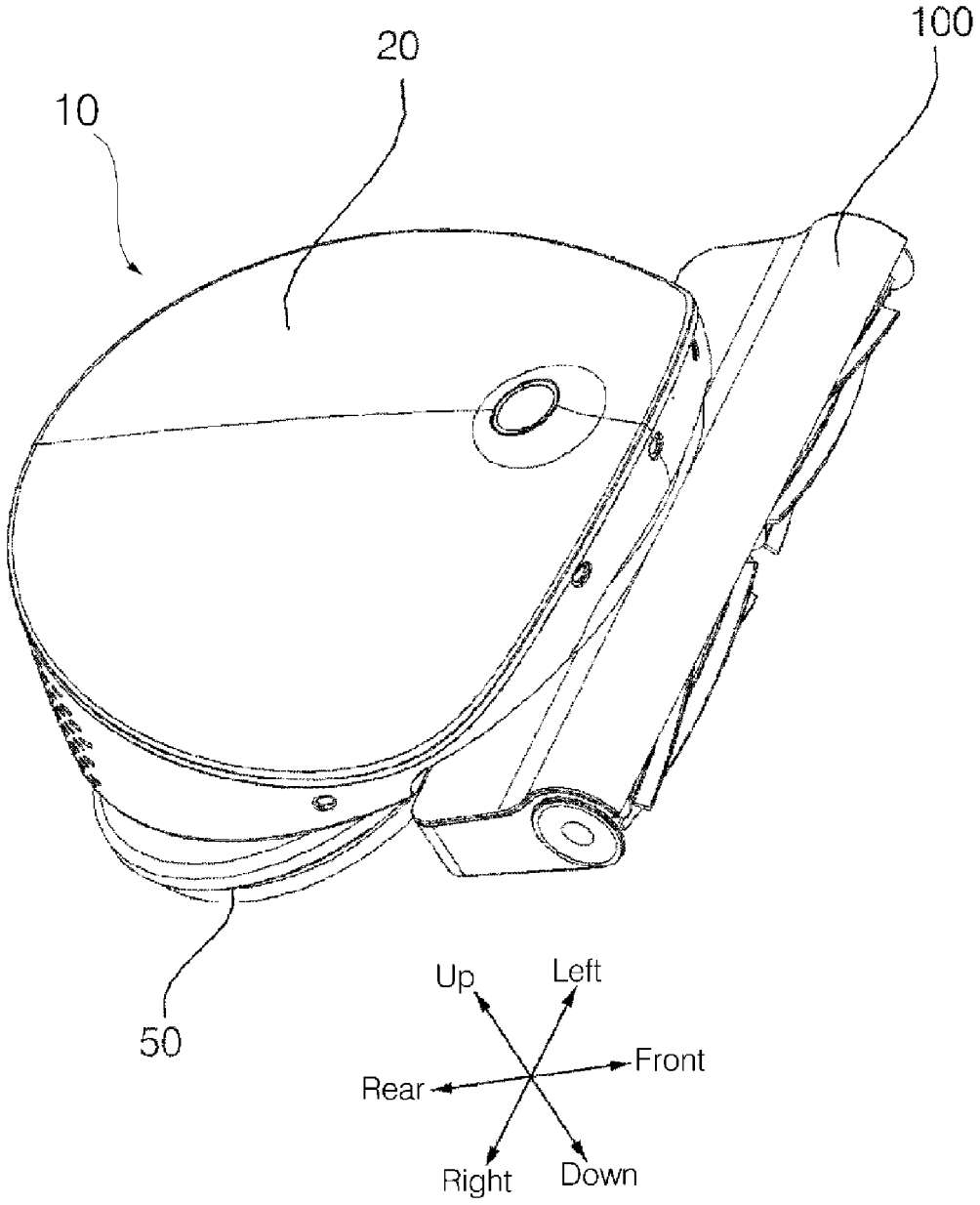
FIG. 1 is a perspective view of a robot cleaner according to an embodiment of the present application.

Exemplary embodiments of the present application are described with reference to the accompanying drawings in detail. The same reference numbers are used throughout the drawings to refer to the same or like parts. Detailed descriptions of well-known functions and structures incorporated herein may be omitted to avoid obscuring the subject matter of the present application. The following expressions of designating directions such as "front/rear/left/right/up/down" are defined as shown in the drawings, but this is only for the purpose of clarifying the present application, and it is obvious that each direction can be defined differently depending on a reference.

Hereinafter, a robot cleaner according to embodiments of the present application will be described with reference to the drawings. A structure of the robot cleaner 10 and a structure of a bumper 100 according to an embodiment will be described with reference to FIG. 1 to FIG. 9.

The robot cleaner 10 according to an embodiment may include a main body 20 forming an outer shape, a moving mechanism 50 to move the main body 20; a bumper 100 positioned to protrude from the outer periphery of the main body 20; an impact sensor 40 positioned obliquely in the main body 20 to detect movement of the bumper 10; and a pressing unit (or pressing extension) 112 having a curved end portion to contact the impact sensor 40 when the bumper 100 moves due to an impact.

A moving mechanism 50 of the robot cleaner may include a driven wheel, a rolling mop, or a spin mop to move the main body 20 to travel. In one embodiment, a spin mop, which rotates while in contact with a floor, is described as the moving mechanism 50, and the moving mechanism will be referred to as the spin mop 50. However, the present application is not limited thereto, but may be applied to a robot cleaner that uses a driven wheel or other moving mechanism.

The main body 20 of the robot cleaner according to the present embodiment may house a controller (not shown) that manages a driving motor that rotates the spin mop 50 to control a movement of the robot cleaner. The controller may determine a position of an obstacle by sensing whether an impact with the obstacle occurs on a front portion or the left and right portions by the impact sensor 40 described below, or determine a cliff on a floor in a cleaning area or the material of the floor by one or more cliff sensors 150*a*, 150*b*.

In addition, depending on the functions of the robot cleaner, an internal cavity of the main body 20 may further house a storage unit (or storage tank) to store water, a flow path that supplies water stored in the storage unit to the spin mop 50, and a pump. The main body 20 may be formed of an upper cover that covers an upper portion of the internal cavity to protect the internal structure and a base connected to the spin mop 50 and to the bumper 100. The base according to one embodiment may form a step at a portion connected to the bumper 100.

The main body 20 according to one embodiment may be connected to the bumper 100 on a first surface 22 and a second surface 24, which are different from each other. For example, the first surface 22 and the second surface 24 may be formed perpendicular to each other. According to one embodiment, the first surface 22 of the main body 20 may be a substantially vertical surface facing toward a front of the robot cleaner, and the second surface 24 may be a substantially horizontal surface facing downward.

On the first surface 22 of the main body 20, a pressing unit insertion hole (or insertion hole) 26 into which a pressing unit 112 of the bumper 100 is inserted may be formed. On the second surface 24 of the main body, a protruding guider (or protruding boss) 28 of a movement guide unit described below and a first protruding member (or a first protrusion) 30 of a disposition restoration unit may protrude.

Figure 2:
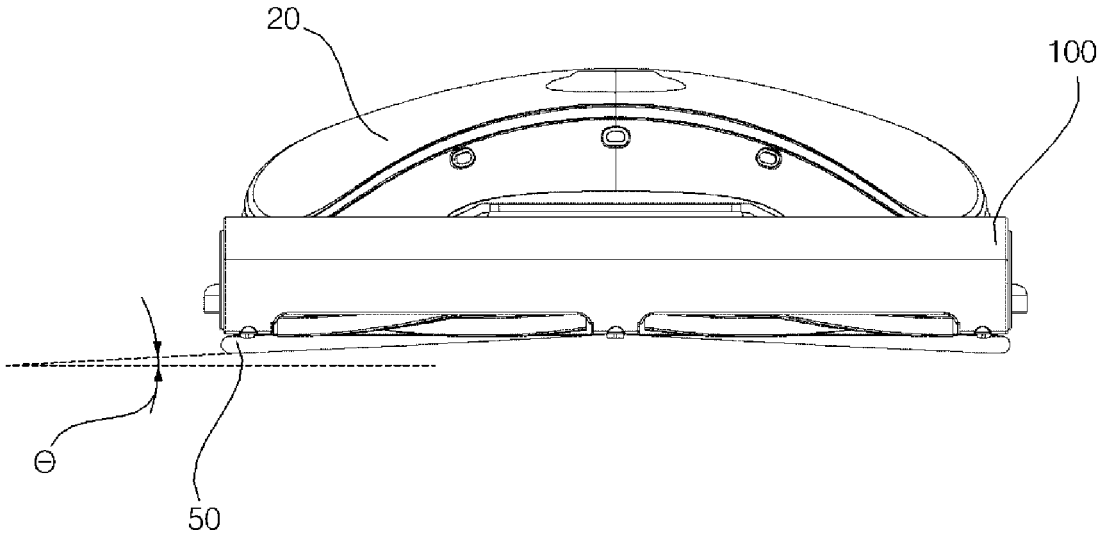
FIG. 2 is a front view of the robot cleaner of FIG. 1.
Figure 3:
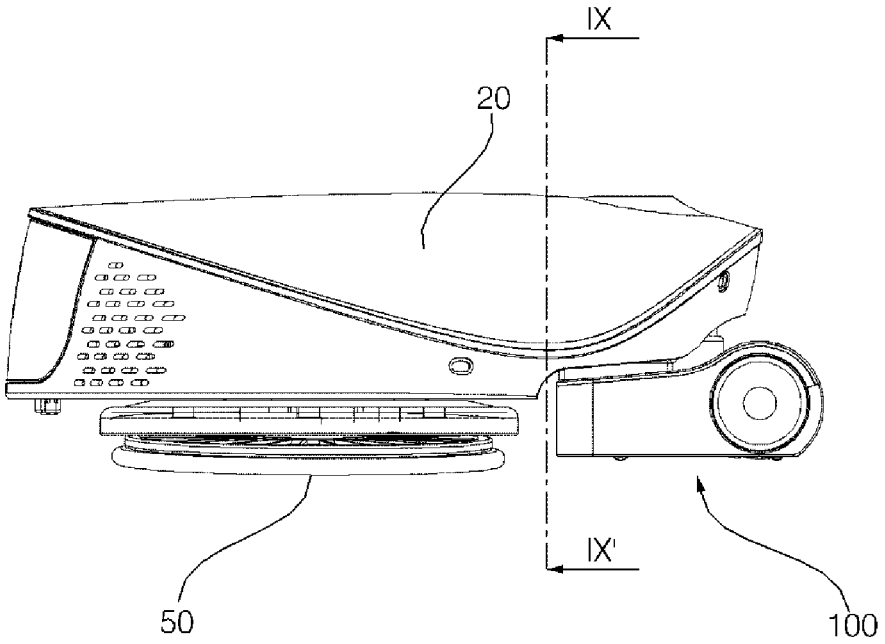
FIG. 3 is a side view of the robot cleaner of FIG. 1.
Figure 4:
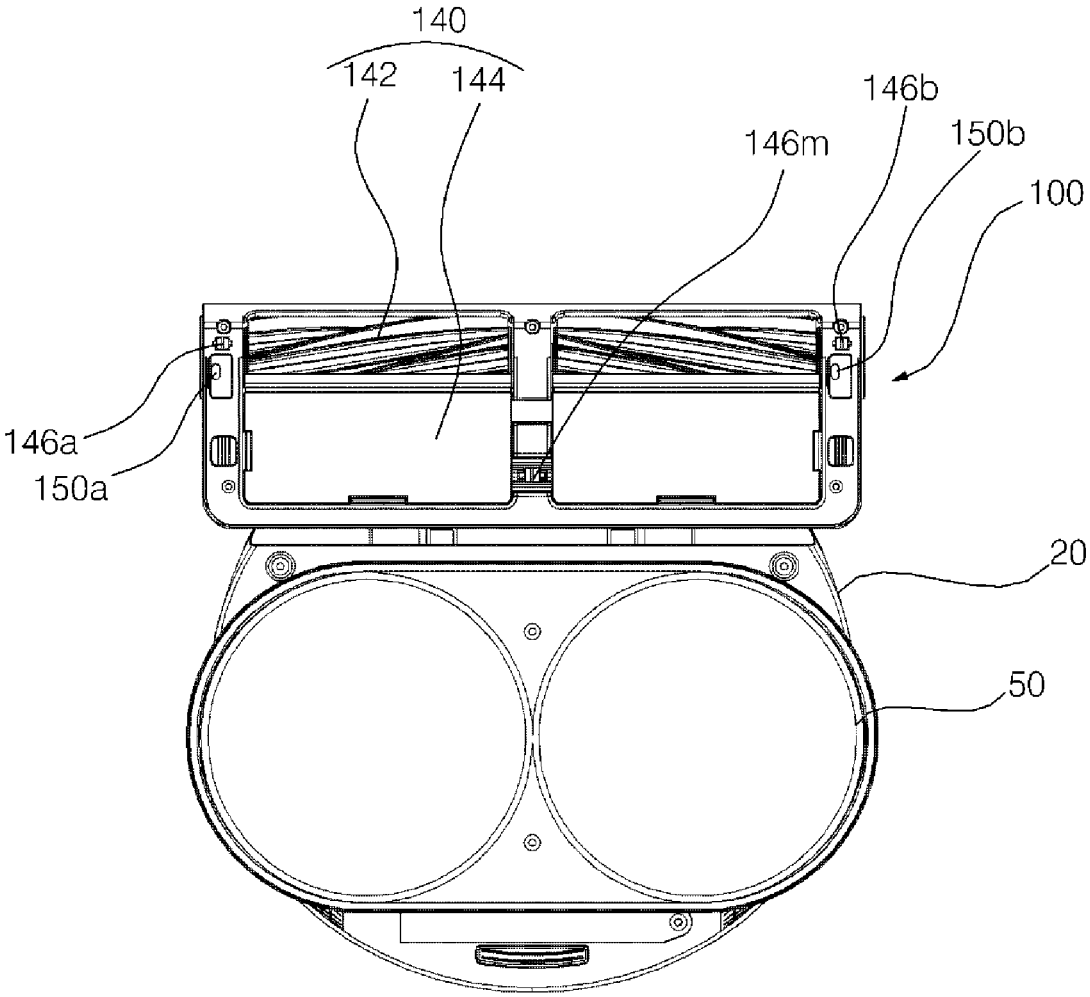
FIG. 4 is a bottom view of the robot cleaner of FIG. 1.
Figure 5:
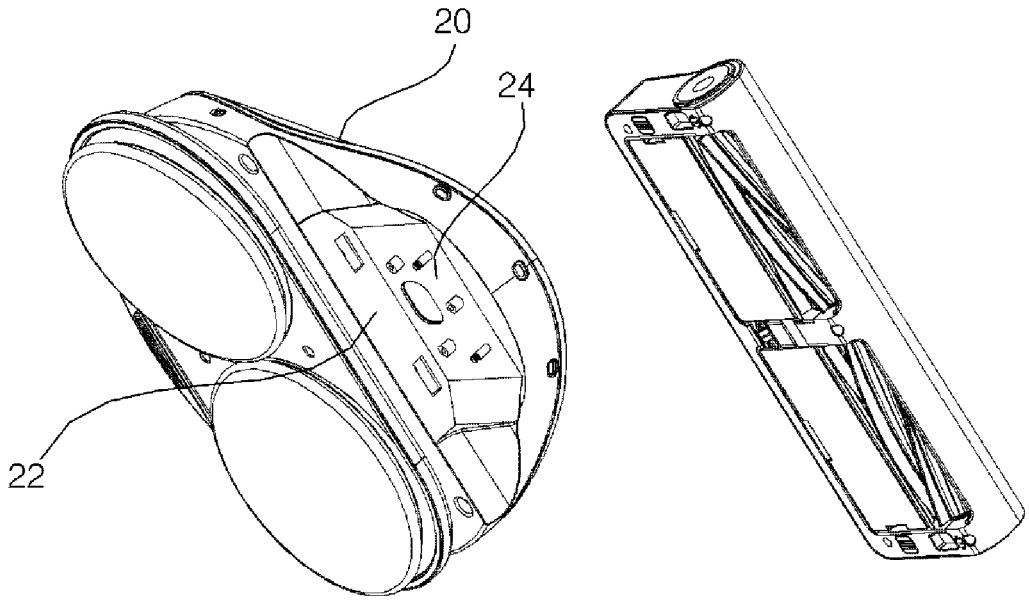
FIG. 5 is a view illustrating a state in which a main body and a bumper of a robot cleaner are separated from each other according to an embodiment of the present application.
Figure 6:
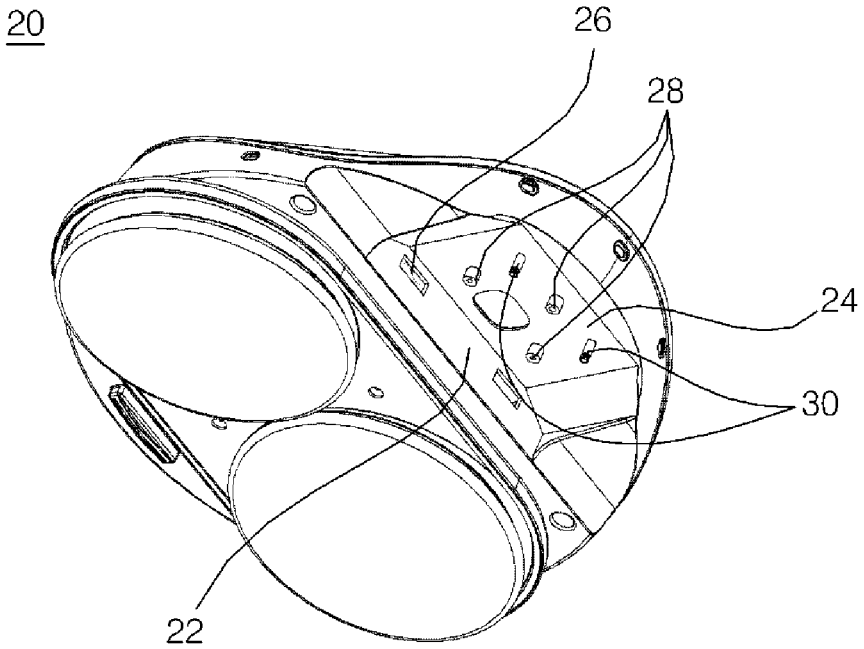
FIG. 6 is a view illustrating a main body according to an embodiment of the present application.

Referring to FIG. 2, the robot cleaner 10 according to one embodiment may include a spin mop 50 that is positioned to rotate around a rotation axis that is substantially perpendicular to the floor and is inclined by a certain angle θ with respect to the floor surface. In order to facilitate the movement of the robot cleaner 10, the spin mop 50 may be positioned in such a manner that the entire surface of the spin mop 50 is not evenly in contact with the floor surface but is tilted by a certain angle θ so that a certain portion of the spin mop is mainly in contact with the floor surface.

The main body 20 may be connected to the spin mop 50. The main body 20 may be moved by the spin mop 50. According to one embodiment, a driving unit, such as a motor, may be driven by received power to rotate or otherwise move the spin mop 50.

The main body 20 may be connected to the bumper 100 at one side. The bumper 100 may be positioned to protrude from the periphery of the main body 20. The bumper 100 may cushion the impact applied to the main body 20. In one example, the bumper 100 may be positioned to protrude in the traveling direction of the robot cleaner 10. In one example, the bumper 100 may be positioned to protrude in the traveling direction of the robot cleaner 10 and the left and right directions of the moving direction. Thus, the bumper 100 according to one embodiment may be positioned to protrude from the front of the main body 20, or the bumper 100 may be positioned to protrude from the front of the main body 20 and in the left and right directions of the main body 20.

Figure 9:
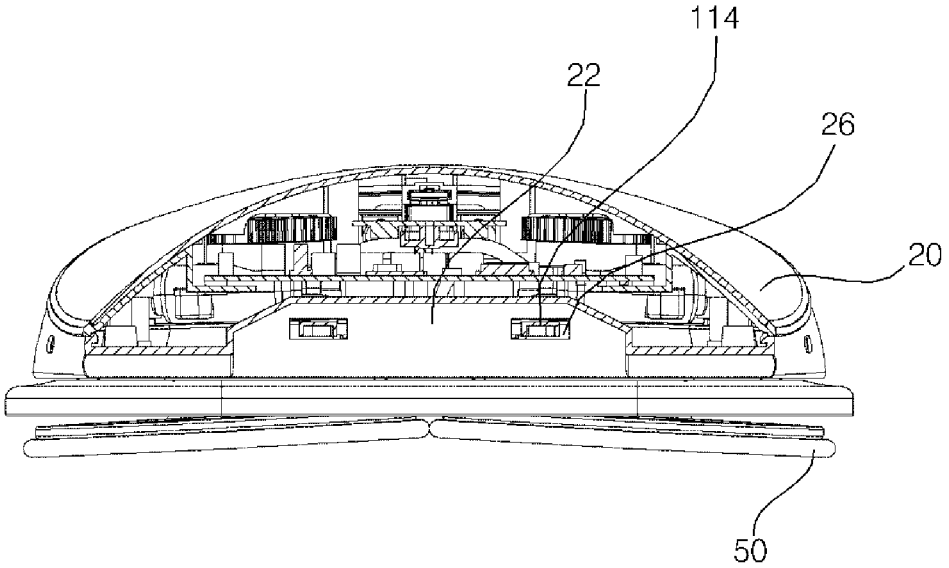
FIG. 9 is a cross-sectional view taken along line IX-IX' of FIG. 3.
Figure 10:
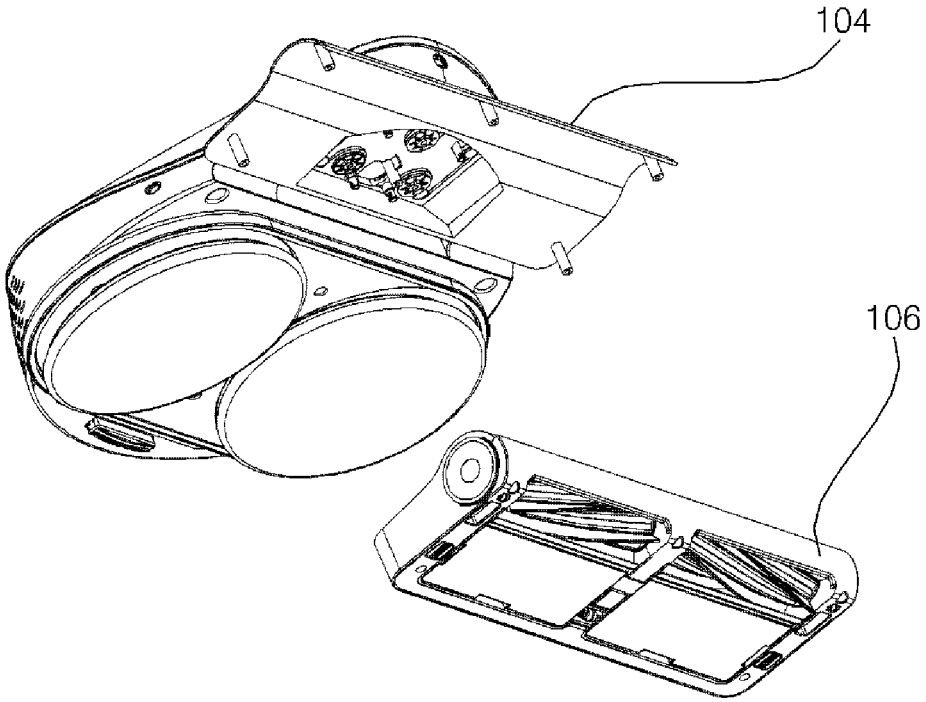
FIG. 10 is a view illustrating a state in which a lower structure of a bumper is separated according to an embodiment of the present application.
Figure 11:
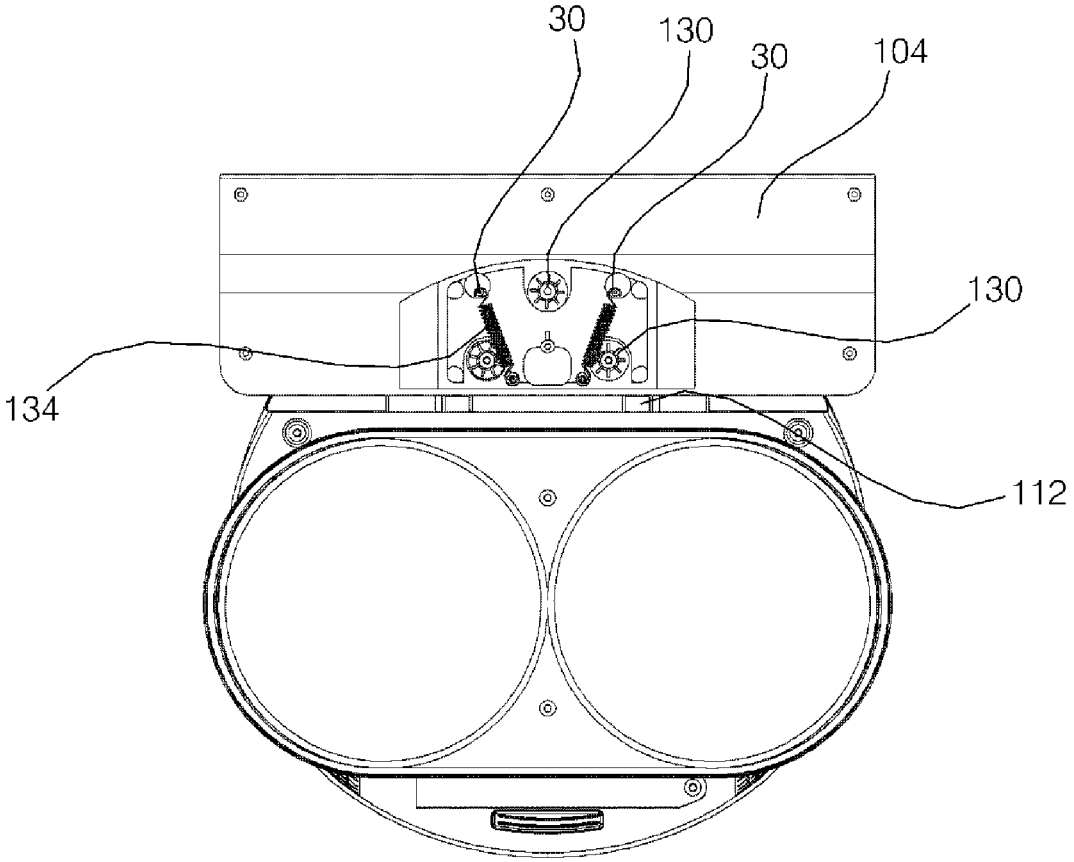
FIG. 11 is a view illustrating a main body of a robot cleaner and an upper structure of a bumper according to an embodiment of the present application.
Figure 12:
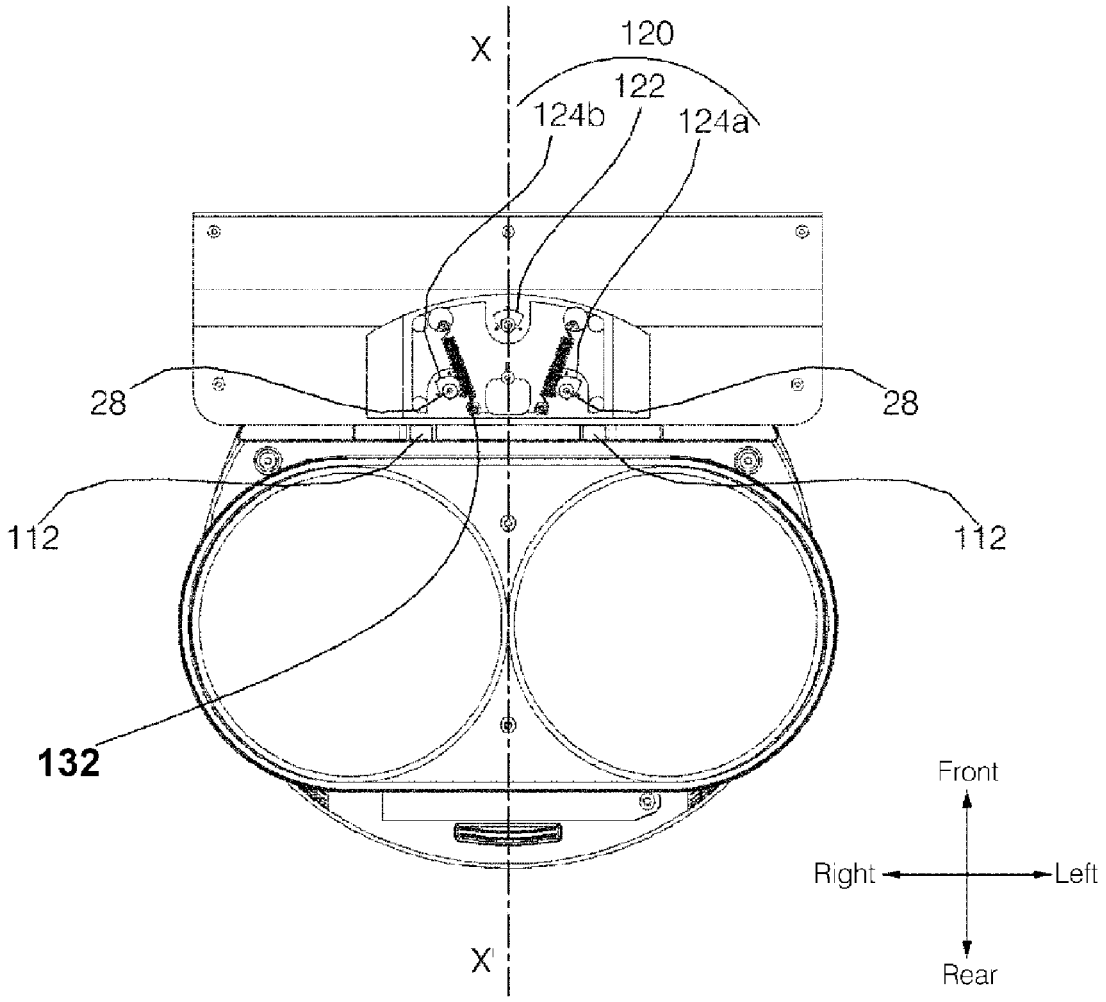
FIG. 12 is a view in which a fixing member is removed in FIG. 11.

Inside the main body, the impact sensor 40, which is a component of an impact detection unit (or impact detection sensor) described below, may be positioned. The pressing unit insertion hole 26 into which the pressing unit 112 protruding to the rear of the bumper 100 is inserted, may be formed at one side of the main body 20. Referring to FIG. 9, the pressing unit insertion hole 26 may be formed to be larger than the cross section of a pressing unit body (or pressing extension) 114 passing through the pressing unit insertion hole 26.

The bumper 100 according to one embodiment may be positioned in a bottom surface of one side of the main body 20. The bumper 100 may be positioned in a bottom side of the main body 20. The bumper 100 may be connected to the main body 20 to be movable in the bottom side of the main body 20.

Figure 7:
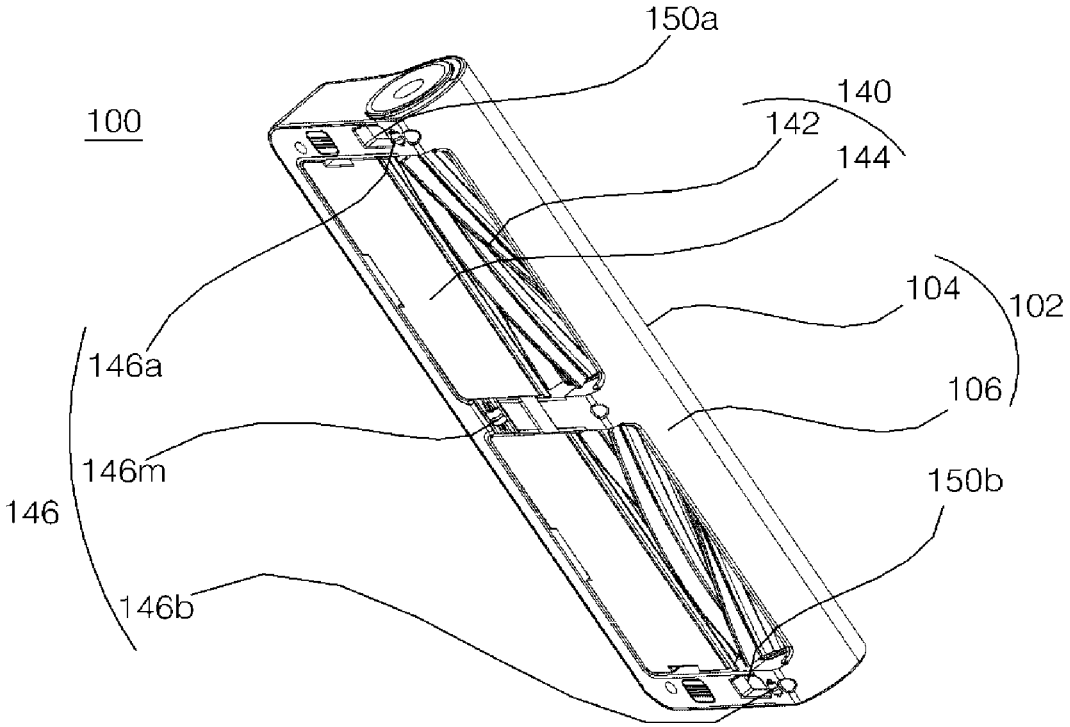
FIG. 7 is a view illustrating a bumper according to an embodiment of the present application.
Figure 8:
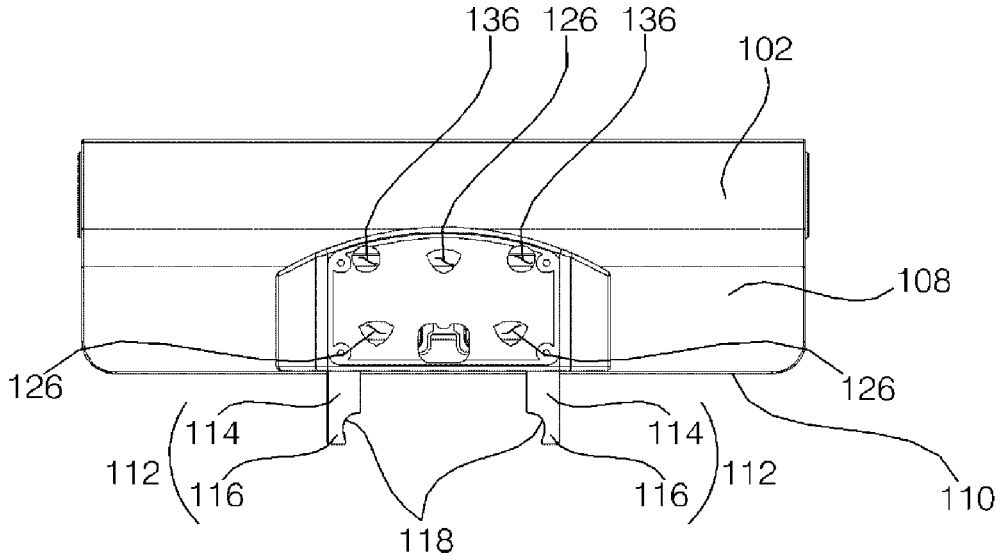
FIG. 8 is a plan view of FIG. 7.

The bumper 100 according to the present embodiment may include a housing 102 forming an outer shape of the bumper 100 (see FIG. 7). The housing 102 may include an upper cover 104 positioned to face a vertical receiving surface (e.g., the second surface 24) of the main body 20, and a lower cover 106 which is coupled with the upper cover 104 in a lower side of the upper cover 104 to protect a component inside the bumper 100.

A guide hole 126 of a movement guide unit described later may be formed on the upper surface of the housing 102, and a pressing unit of the impact detection unit described later may protrude from the rear surface 110 of the housing 102. The pressing unit 112 may protrude in a rear direction from the rear surface of the housing 102. A guide hole 126 of the movement guide unit that restricts a movement of the bumper may be formed on the upper surface 108 of the housing, and a pressing unit 112 that transmits a force of an impact applied to the bumper 100 to the impact sensor 40 may protrude from the rear surface of the housing. The pressing unit 112 may protrude in a rear direction from the rear surface of the housing 102.

A cleaning module (or cleaning head) 140 that removes foreign substances on a cleaning target surface may be received inside the bumper 100 according to the present embodiment. A space to receive the cleaning module 140 may be formed inside the housing 102 of the bumper 100 according to one embodiment. The cleaning module 140 may be coupled to a one or more dust containers (or dust bins) 144 which receive foreign substances suctioned into or otherwise flowing into the housing 102 of bumper 100 and are detachably coupled into the lower side of the housing 102; and a one or more agitators (or rollers) 142 which are positioned inside the bumper housing 102 and may send foreign substances existing on a cleaning target surface to the pair of dust containers 144 by a rotating operation. The pair of agitators 142 may include brushes or extensions that sweep the cleaning target surface by the rotating operation and move the foreign substances existing on the cleaning target surface to the dust container 144 positioned in a rear side.

The robot cleaner 10 may include the spin mop 50 and an auxiliary wheel 146 positioned in a position spaced forward. The bumper 100 according to one embodiment may include an auxiliary wheel 146 contacting the floor. The auxiliary wheel 146 may be positioned on the bottom surface of the housing 102 of the bumper 100.

The auxiliary wheel 146 may prevent the robot cleaner 10 from rolling over in the front-rear direction. The auxiliary wheel 146 may set the relative position of the cleaning module 140 with respect to the floor, thereby allowing the cleaning module 140 to efficiently perform cleaning.

The auxiliary wheel 146 may be positioned in the lower side of the housing 102 of bumper 100. The auxiliary wheel 146 may facilitate the front-rear direction movement for the bottom surface of the bumper 100. Referring to FIG. 7, the auxiliary wheel 146 may be provided in such a manner that the floor and the lower side of the housing 102 of bumper 100 are spaced apart from each other within a range in which the pair of agitators 142 can contact the horizontal floor.

The bumper 100 according to one embodiment may be provided with a plurality of auxiliary wheels 146*a*, 146*b*, 146*m*. The plurality of auxiliary wheels 146*a*, 146*b*, 146*m* may be provided to be laterally symmetrical.

The robot cleaner 10 according to one embodiment may include a pair of auxiliary wheels 146*a*, 146*b* which are positioned in the left and right sides of the bumper 100 respectively. For example, the left auxiliary wheel 146*a* may be positioned in the left side of the cleaning module 140, and the right auxiliary wheel 144*b* may be positioned in the right side of the cleaning module 140. The pair of auxiliary wheels 144*a*, 144*b* may be positioned in a bilateral symmetric position.

Further, a central auxiliary wheel 144*m* may be provided. The central auxiliary wheel 144*m* may be positioned between the pair of dust containers 143. The central auxiliary wheel 144*m* may be positioned in a position spaced apart in the front-rear direction from the pair of auxiliary wheels 144*a*, 144*b*.

The robot cleaner 10 according to the present embodiment may include a cliff sensor 150*a*, 150*b* to detect a cliff on a floor in a moving area. The robot cleaner 10 according to the present embodiment may include a plurality of cliff sensors 150*a*, 150*b*. The cliff sensor 150*a*, 150*b* according to one embodiment may be positioned in a front portion of the robot cleaner 10. The cliff sensor 150*a*, 150*b* according to one embodiment may be positioned in one side of the bumper 100.

The cliff sensor 150*a*, 150*b* according to one embodiment may include at least one light emitting element (or emitter) and at least one light receiving element (or light detector). The controller may determine the material of the floor based on the amount of light which is output from the light emitting element, reflected by the floor, and received by the light receiving element.

For example, when the amount of the reflect light is equal to or greater than a certain threshold value, the controller may determine the material of the floor corresponds to a hard floor (e.g., a tile, wood, or stone flooring), and when the amount of the reflect light is smaller than the certain threshold value, the controller may determine the material of the floor corresponds to a carpet. Specifically, the floor may have different degrees of reflection of light depending on the flooring material, and the hard floor may reflect a relatively large amount of light, while a carpet may reflect relatively less light. Therefore, the controller may determine the material of the floor based on the amount of the light which is output from the light emitting element, reflected by the floor, and received by the light receiving element. For example, when the amount of the reflect light is equal to or greater than a certain reference value, the controller may determine that the floor is a hard floor, and when the amount of the reflect light is smaller than the certain reference value, the controller may determine the material of the floor is a carpet.

Meanwhile, a reference value used to determine the material of the floor may be set based on a distance between the floor and the cliff sensor 150*a*, 150*b*. For example, a first reference value may be used when the distance from the floor detected by the cliff sensor 150*a*, 150*b* is 25 mm, and the second, different reference value may be used when the distance is 35 mm.

Meanwhile, when the distance from the floor is relatively short, a significant difference in the amount of reflect light may not be detectable. Therefore, the controller may determine the floor material based on reflected light only when the distance from the floor detected by the cliff sensor 150*a*, 150*b* is a certain distance or more. For example, the controller 100 may determine the material of the floor based on the amount of detected reflect light when the distance from the floor detected by the cliff sensors 150*a*, 150*b* is 20 mm or more.

According to an embodiment of the present application, carpet or other floor material may be identified based on the amount of reflect light detected by the cliff sensor 150*a*, 150*b*, and the floor material may be verified based on the current load driving the drive motor. For example, the drive motor may require more power to move the robot cleaner 10 on a relatively softer flooring surface. Thus, the floor material may be more accurately identified.

The bumper 100 according to the present embodiment may be positioned at a front of the robot cleaner 10, and may sense an obstacle or a cliff positioned in the moving direction of the robot cleaner 10 and detect the material of the floor positioned in the front in the moving direction.

Hereinafter, an impact detection unit, a movement guide unit, and a disposition restoration unit of the robot cleaner according to the present embodiment will be described with reference to FIG. 10 to FIG. 13. The robot cleaner 10 according to one embodiment may include the impact detection unit (or impact detection module) that detects an impact generated in the bumper 100, the movement guide unit (or movement guide module) that guides or otherwise restricts the movement of the bumper 100, and the disposition restoration unit (or restoration module) to restore the position of the bumper 100 changed by an external impact.

The impact detection unit may detect an impact of the bumper 100 applied by an external force. The impact detection unit may detect the impact of the bumper 100 by the impact sensor 40. The impact generated in the bumper 100 may be generated when the bumper 100 moves due to contact with an external object during the movement of the robot cleaner, or when the bumper 100 moves as an external pressure is applied to the bumper 100 regardless of the movement of the robot cleaner 10.

The impact detection unit may include the impact sensor 40 to detect an external impact and the pressing unit 112 that transmits the impact generated in the bumper 100 to the impact sensor 40. The impact sensor 40 may be fixedly positioned inside the main body 20. The impact sensor 40 according to an embodiment may be positioned inside the main body 20 and, more specifically, may be positioned rearward of the pressing unit insertion hole 26. The impact sensor 40 may detect the movement of the bumper 100. The impact sensor 40 may include a switch lever 44 to receive the force of the impact of the bumper 100 due to a movement of the pressing unit 112 and a sensor body 42 that detects the impact of the bumper 100 based on a movement of the switch lever 44. The switch lever 44 according to one embodiment may be equipped with a rotary roller 46 which is rotatably mounted in an end portion thereof.

A pair of the impact sensors 40 may be positioned to be laterally symmetrical based on a virtual center line X-X' that divides the bumper 100 into left and right sides. Each of the impact sensors 40 may detect the impact of the bumper 100 generated in a range between a front direction and a respective lateral direction in which the impact sensor 40 is positioned based on the center line X-X'.

Figure 13:
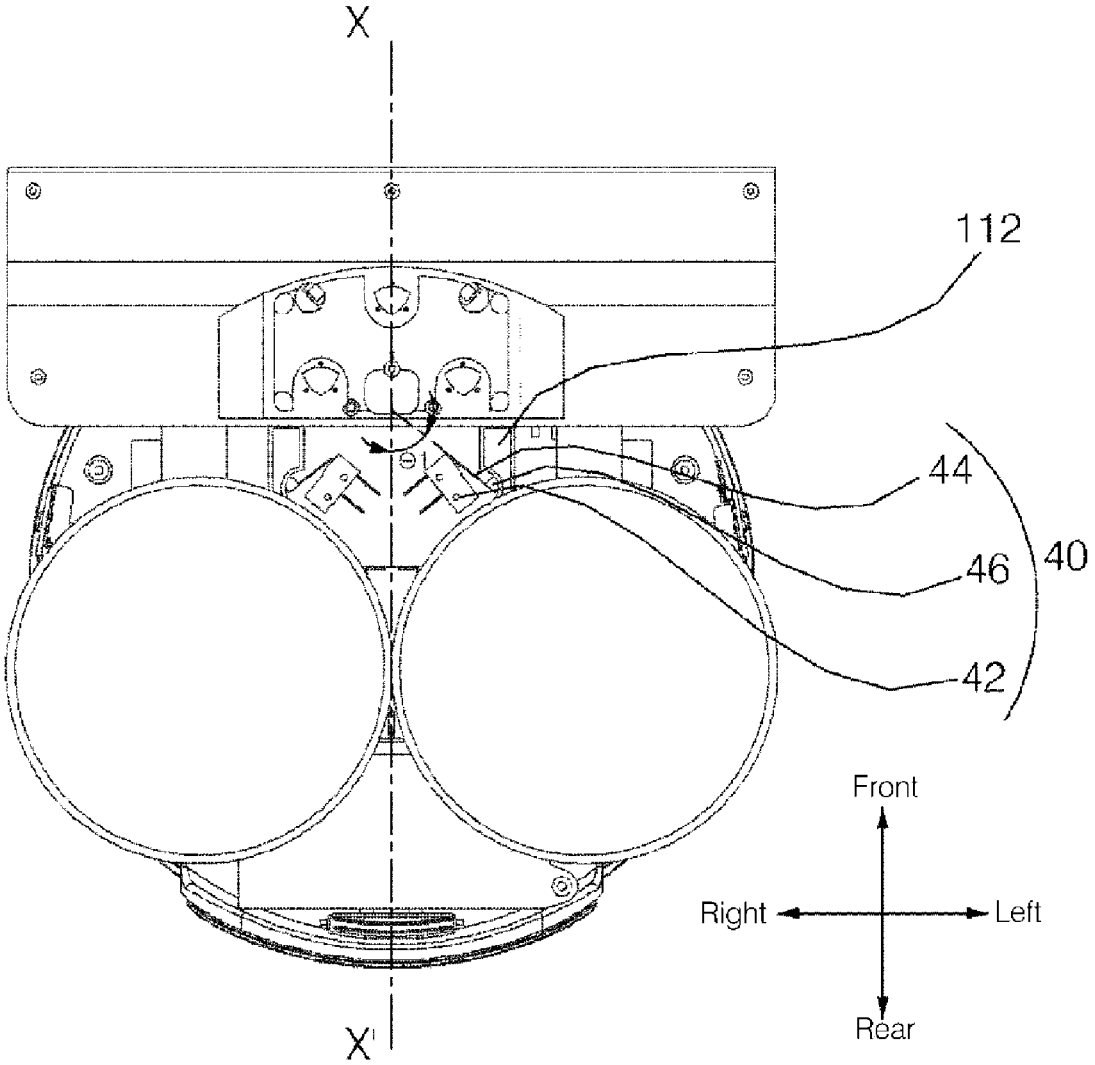
FIG. 13 is a view illustrating a state in which a base of a main body is removed in FIG. 12.

Each impact sensor 40 may be obliquely positioned (e.g., at a slant), as shown in FIG. 13. The switch lever 44 may be obliquely positioned from the sensor body 42 in a rearward direction, as shown in FIG. 13. The angle (θ1) of the switch lever inclined from the center line (X-X') may be formed between 30° and 60°.

The pressing unit (or pressing protrusion) 112 may protrude from one surface of the bumper 100 in the direction in which the impact sensor 40 is positioned. The pressing unit 112 according to the present embodiment may protrude in the direction of the impact sensor 40 positioned in a rear side of the bumper 100. Each pressing unit 112 may include an end portion (or pressing end) 116 that forms a curved surface 118 to press one side of the impact sensor 40, and a pressing unit body 114 that protrudes from the rear of the bumper 100 and extends to the end portion 116. The pressing unit body 114 may protrude from the rear of the bumper 100, pass through the pressing unit insertion hole 26 of the main body 20, and extend into the main body 20. The pressing unit insertion hole 26 may be formed to be larger than a cross section of the pressing unit body 114 passing through the pressing unit insertion hole 26 to enable the bumper 100 to move to the left and/or right in response to an impact.

The pressing unit 112 may protrude from the rear surface of the bumper 100. The pressing unit 112 may move together with the bumper 100. The end portion 116 of the pressing unit 112 may be positioned adjacent to or in contact with an end portion of the switch lever 44. The pressing unit 112 may have a bar shape protruding in a rearward direction of the bumper 100, and the end portion 116 thereof may have a curved shape. The pressing unit 112 may press the end portion of the switch lever 44 based on an impact to the bumper 100 between the side direction and the front direction of the bumper 100.

The pressing unit 112 may transmit the impact generated in the bumper 100 to the impact sensor 40. The pressing unit 112 may be positioned adjacent to the end portion of the switch lever 44. The end 116 of the pressing unit 112 may have a curved shaped surface 118 that envelops or otherwise contacts one side of the rotary roller 46 positioned in the end portion of the switch lever 44. The pressing unit 112 may have a shape that envelops the end portion of the switch lever 44.

The robot cleaner 10 according to one embodiment may include a movement guide unit (or bumper guide) 120 that restricts the movement range of the bumper 100. The movement guide unit may include a protruding guider (or boss) 28 that protrudes from the main body 20 and restricts the movement of the bumper 100, and a bumper guider 120 that forms a guide hole 126 around the protruding guider 28 and guides a movement of the bumper 100. The movement guide unit may restrict the movement of the bumper 100. Even if a relatively large impact is applied to the bumper 100, the bumper 100 may not move over a certain range due to the movement guide unit since the motion of the protruding guider 28 is limited by the guide hole 126.

The bumper guider 120 may be formed on the bumper 100. The bumper guider 120 may include the guide hole 126 having a substantially inverted triangular shape in which a portion of the guide hole 126 directed frontward is relatively wider than another portion of the guide hole 126 directed rearward. The protruding guider 28 may generally be positioned in a rear side of the guide hole 126 of the bumper guider in a state (hereinafter referred to as a "reference position") where no external force is applied. The bumper guider 120 may move together with the bumper 100.

The movement of the bumper guider 120 may be restricted by the protruding guider 28. The protruding guider 28 may be a member protruding from the main body 20. The protruding guider 28 may be positioned inside the guide hole 126 formed by the bumper guider 120.

A fixing nut 130 that connects the bumper 100 to the main body 20 may be fastened to an end of the protruding guider 28. The fixing nut 130 may be fastened to the protruding guider 28 within a range that does not restrict the front, rear, and left-right movement of the bumper 100. The protruding guider 28 and the fixing nut 130 may restrict the vertical movement of the bumper 100.

The bumper guider 120 may include a rear bumper guider 124 positioned on a virtual center line X-X' that divides the bumper 100 into left and right sides in the rear portion of the bumper 100, and a front bumper guider 122 positioned laterally symmetrical based on the center line X-X' in front of the rear bumper guider 124.

The rear bumper guider 124 may include a left rear bumper guider **124*a* formed in the left side of the center line X-X' and a right rear bumper guider 124*b* formed in the right side of the center line X-X'. The left rear bumper guider 124*a* and the right rear bumper guider 124*b*** may have a shape and a disposition which are symmetrical based on the center line X-X'.

The robot cleaner 10 according to the present embodiment may include an disposition restoration unit to restore the bumper 100, which has been moved by an external impact, back to a reference position. As previously described the reference position of the bumper 100 may refer to a position of the bumper 100 when no impact or other external force is applied. The bumper 100 maintains the reference position due to the elastic force of an elastic member (or spring) 134 of the disposition restoration unit when no external force is applied. In the reference position, the bumper 100 according to the present embodiment may be laterally symmetrical based on the center line X-X', and may extend in a generally forward direction due to the elastic force of the elastic member 134.

The disposition restoration unit may include a first protruding member (or first protrusion) 30 protruding from the main body 20, a second protruding member (or second protrusion) 132 protruding from the bumper 100 in parallel with the first protruding member 30, and an elastic member (or spring) 134 that is connected to the first protruding member 30 and the second protruding member 132 and provides an elastic force to restore the position of the bumper 100 to the reference position. On the bumper 100, a protruding member hole 156 through which the first protruding member 30 extends may be formed. The first protruding member 30 may be positioned farther from the center line X-X' than the second protruding member 132 and may be positioned relatively forward of the second protruding member 132.

The disposition restoration unit may include a left restoration unit provided in the left side of the bumper 100 and a right restoration unit provided in the right side of the bumper 100. Each of the left restoration unit and the right restoration unit may include the first protruding member 30, the second protruding member 132, and the elastic member 134. The left restoration unit may apply an elastic force to the bumper 100 in a left front direction of the main body 20 and the right restoration unit may apply an elastic force to the bumper 100 in a right front side of the main body 20.

The elastic forces generated in the elastic members 134 of the left restoration unit and the right restoration unit may be substantially similar in magnitude and may different only the applied directions. The bumper 100 may protrude substantially forward from the front center of the main body 20 due to the elastic forces applied to the bumper 100 simultaneously by the left restoration unit and the right restoration unit.

FIGS. 14A-14D are views related to explaining a position change of the impact detection unit and the movement guide unit due to the movement of the bumper 100 according to an embodiment of the present application. Hereinafter, the movement of the bumper guide and the recognition of the impact detection unit according to each case in which an impact is applied to the bumper will be explained with reference to FIGS. 14A-14D.

Figure 14A:
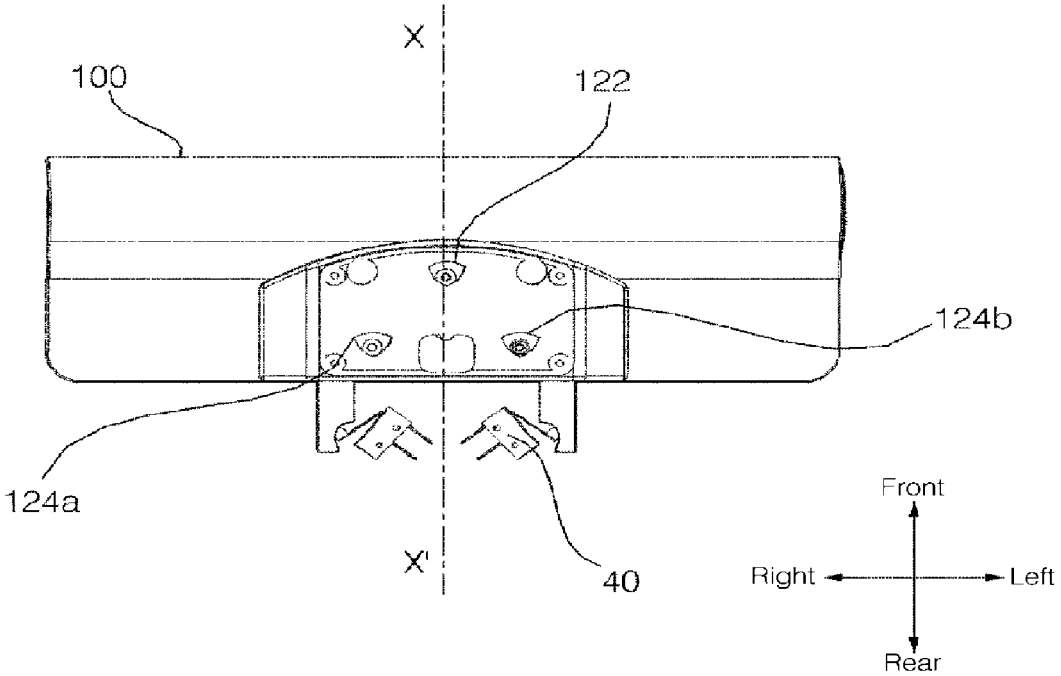
FIG. 14A is a view for explaining basic positions of an impact detection unit and a movement guide unit according to movement of a bumper according to an embodiment of the present application.

When an impact is applied to the bumper 100, the bumper 100 may move due to the impact. When the bumper 100 is moved, the pressing unit 112 may move together with the bumper 100 and press or otherwise be detected by the impact sensor 40. As shown in FIG. 14A, the bumper 100 may maintain the reference position when an external force is not applied to the bumper 100, and the pressing unit 112 may not press or otherwise activate the impact sensor 40.

Figure 14B:
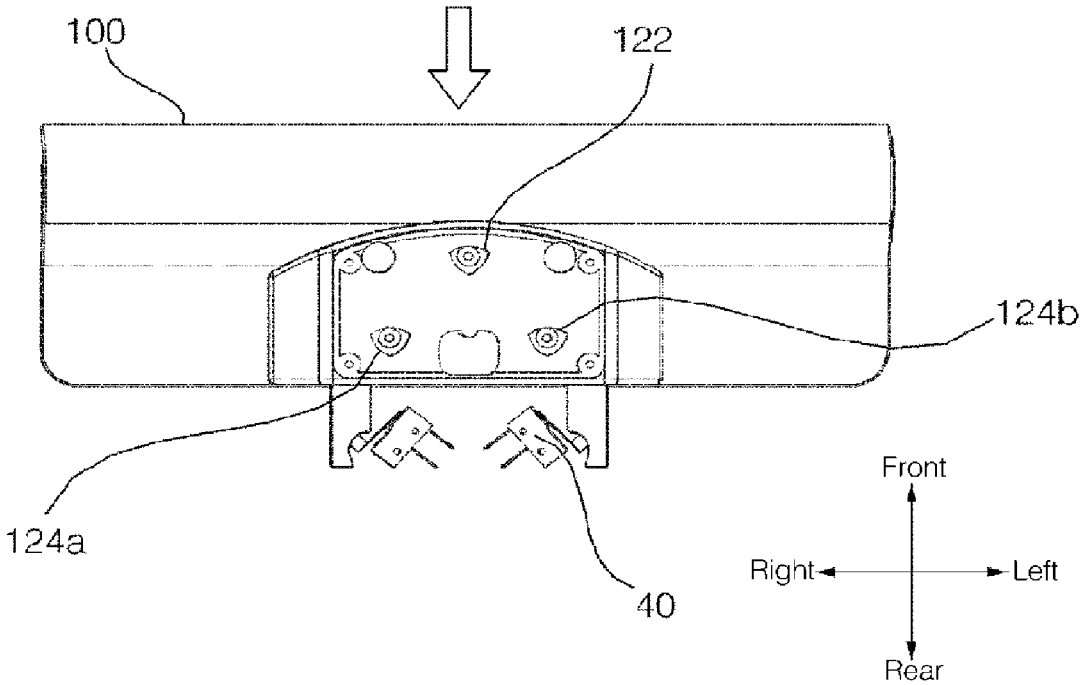
FIG. 14B is a view for explaining positions of an impact detection unit and a movement guide unit according to movement of a bumper when an impact is applied to a front center portion of a bumper according to an embodiment of the present application.

As shown in FIG. 14B, when an impact is applied substantially from the front of the bumper 100, the bumper 100 may move substantially backward. The bumper 100 may move backward within the range of the movement guide unit. When the bumper 100 moves backward, each of the pressing units 112 positioned in the left and right sides based on the center line X-X' may press a corresponding impact sensor 40. For example, the end portion 116 of each of the pressing unit 112 may press the impact sensor 40. Due to the rearward movement of the bumper 100 from the front impact, each protruding guide may be positioned in the front side of the guide hole formed by each bumper guider 120.

Figure 14C:
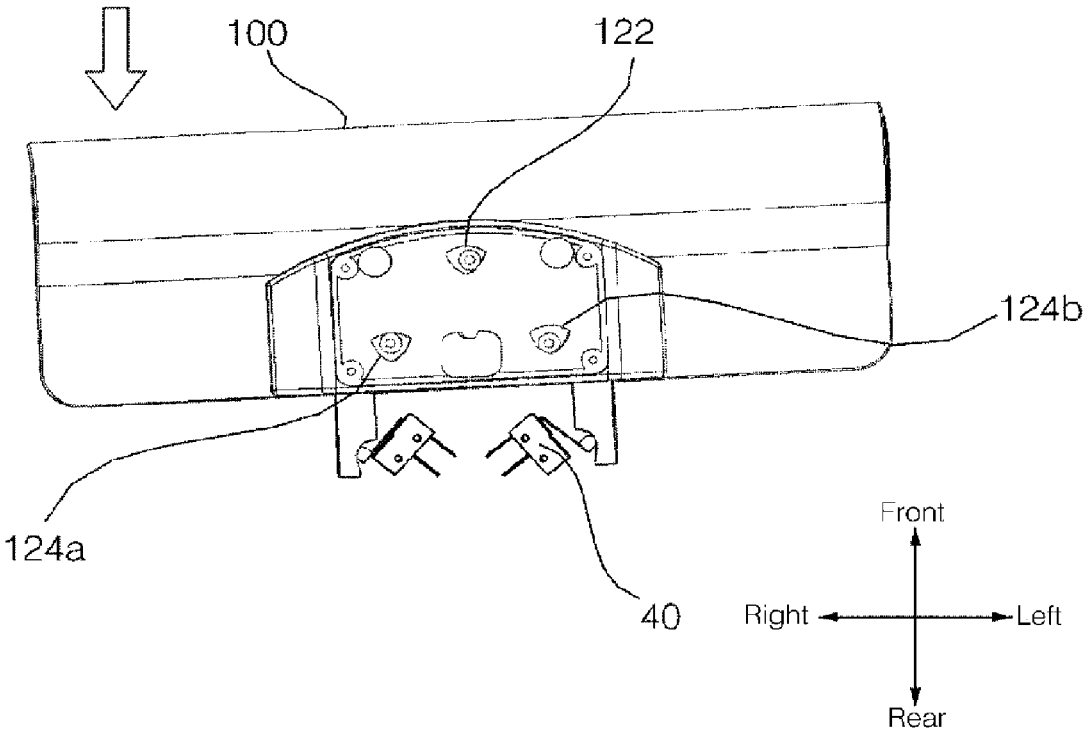
FIG. 14C is a view for explaining positions of an impact detection unit and a movement guide unit according to movement of a bumper when an impact is applied to a front side portion of a bumper according to an embodiment of the present application.

When an impact is applied from one side of the front side of the bumper 100, one side of the front side of the bumper 100 subjected to the impact may move backward. When an impact is diagonally applied from the left side of the front side of the bumper 100 as shown in FIG. 14C, the left side of the front side of the bumper 100 subjected to the impact may move backward, but the right side in front of the bumper 100 may not move by the right restoration unit or may move slightly in comparison with the left front side. With the diagonal movement of the bumper 100, the protruding guider 28 positioned inside the guider hole formed by the left rear bumper guider 124*a* may be positioned in front of the guider hole.

Figure 14D:
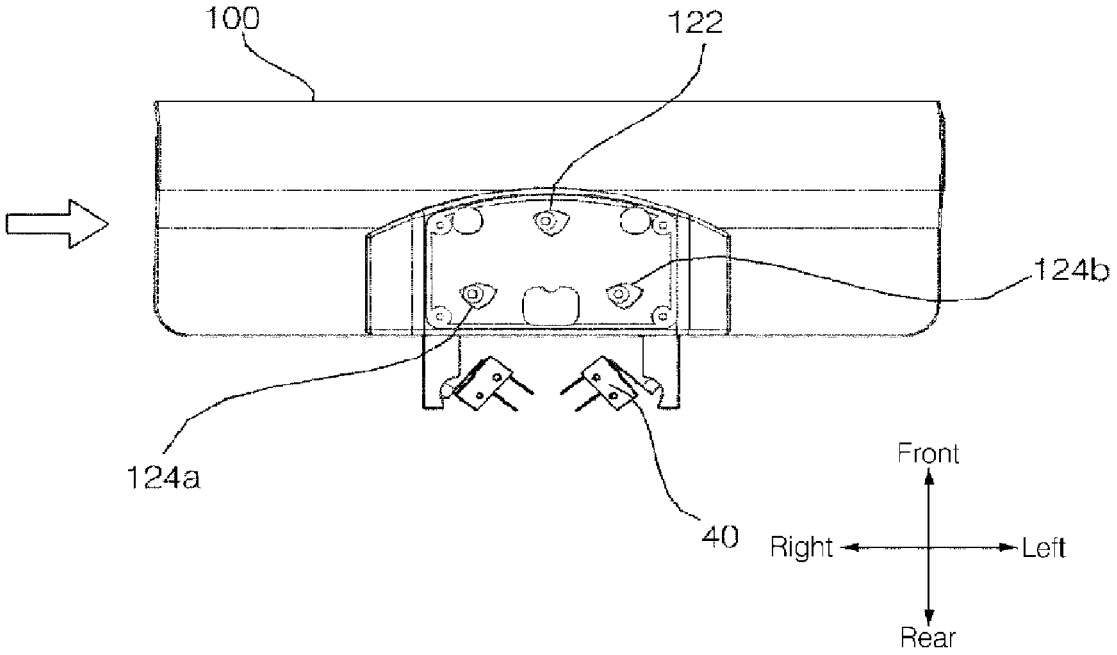
FIG. 14D is a view for explaining positions of an impact detection unit and a movement guide unit according to movement of a bumper when an impact is applied to a side portion of a bumper according to an embodiment of the present application.

When an impact is applied from the side surface of the bumper 100 as shown in FIG. 14D, the bumper 100 may move sideways and in a direction opposite to the side surface to which the impact is applied. With the sideways movement of the bumper 100, the pressing unit 112 positioned in the left side may press the impact sensor 40. The end portion 116 of the pressing unit 112 positioned in the left side may press the impact sensor 40. With the sideways movement of the bumper 100, the protruding guider 28 positioned inside the guider hole formed by the front bumper guider 122 may be positioned in the left side of the guider hole.

The robot cleaner 10 according to the present embodiment may detect the position where the obstacle is positioned by the operation of the impact sensor 40. As shown in FIG. 14B, when both the left impact sensor 40 and the right impact sensor 40 of the robot cleaner 10 operate, robot cleaner 10 can determine that an obstacle is located ahead.

When the left impact sensor 40 is operated, the robot cleaner 10 may recognize that an obstacle is located in the left front side or the left side. Similarly, when the right impact sensor 40 is operated, the robot cleaner 10 may recognize that an obstacle is located in the right front side or the right side.

According to the robot cleaner of the present application, one or more of the following aspects can be obtained. First, in the robot cleaner according to the present application, since the impact sensor is positioned obliquely and the pressing unit is formed in a bent shape in the end portion of the impact sensor, a small number of impact sensors can detect impacts in various directions, which is advantageous in terms of size and cost. Second, in the robot cleaner of the present application, the protruding guider moves in the range of the bumper guider to restrict the movement of the bumper, to thereby prevent damage to the robot cleaner caused by excessive movement of the bumper from a relatively large impact force. Third, in the robot cleaner of the present application, the pressing unit to press the impact sensor to the rear side of the bumper extends a relatively long distance, which enables a sensor to be sensitive to the impact from the front of the robot cleaner.

The present application provides a robot cleaner that detects the impact in a plurality of directions by using a small number of impact sensors. The present application further provides a robot cleaner that adjusts the moving direction of a bumper.

In accordance with an aspect of the present application, a robot cleaner may include: a main body which forms an external shape; a moving mechanism which moves the main body; a bumper which is positioned to protrude from an outer periphery of the main body; an impact sensor which is positioned obliquely in the main body to detect movement of the bumper; and a pressing unit having a curved end portion which presses the impact sensor, when the bumper moves.

The pressing unit may protrude from the rear of the bumper, and the main body may have a pressing unit insertion hole through which the pressing unit is inserted from one side. The main body may be connected to the bumper on a first surface and on a second surface perpendicular to the first surface.

A pressing unit insertion hole into which the pressing unit protruding from a rear of the bumper is inserted may be formed on the first surface, and a protruding guider restricting movement of the bumper may protrude from the second surface. A pair of the impact sensors may be positioned to be laterally symmetrical based on a virtual center line that divides the bumper into left and right sides, and each of the impact sensors may include a switch lever which receives an impact of the bumper due to movement of the pressing unit; a sensor body which detects the impact of the bumper due to movement of the switch lever; and a rotary roller which is rotatably mounted in an end portion of the switch lever, wherein the switch lever is positioned obliquely in a back direction based on the virtual center line. The end portion of the pressing unit may be formed in a curved shape that envelops or otherwise contacts one side of the rotary roller.

The robot cleaner further may include: a movement guide unit which restricts a movement range of the bumper; and a disposition restoration unit which restores a position of the bumper changed by an external impact.

The movement guide unit may include a protruding guider which protrudes from the main body and restricts movement of the bumper, and a bumper guider which forms a guide hole around the protruding guider and guides moving of the bumper, wherein the bumper guider includes a front bumper guider which is positioned on a virtual center line that divides the bumper into left and right sides in a front portion of the bumper, and a pair of rear bumper guiders which are positioned in a rear portion of the front bumper guider and positioned to be laterally symmetrical based on the center line. The movement guide unit may further include a fixing nut which is fastened to the protruding guider within a range that does not restrict a front, rear, and left-right movement of the bumper.

The disposition restoration unit may include: a first protruding member which protrudes from the main body; a second protruding member which protrudes from the bumper in parallel with the first protruding member; and an elastic member which elastically connects the first protruding member and the second protruding member.

Hereinabove, although the present application has been described with reference to exemplary embodiments and the accompanying drawings, the present application is not limited thereto, but may be variously modified and altered by those skilled in the art to which the present application pertains without departing from the spirit and scope of the present application claimed in the following claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present application.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the application. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this application belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the application. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A robot cleaner comprising:

a main body which forms an external shape;

a moving mechanism which provides a driving force to move the main body;

a bumper which protrudes from an outer periphery of the main body and moves when impacting an obstacle;

an impact sensor which is positioned obliquely in the main body; and a pressing protrusion which is coupled to the bumper and includes a curved end surface which moves to contact the impact sensor when the bumper moves, wherein the main body is connected to the bumper on a first surface and on a second surface perpendicular to the first surface, wherein an insertion hole into which the pressing protrusion is inserted is formed on the first surface, and wherein a protruding boss protrudes from the second surface and extends through an opening in the bumper to restrict a movement of the bumper.

2. The robot cleaner of claim 1, wherein the pressing protrusion protrudes from a rear surface of the bumper, and the main body includes an insertion hole through which a portion of the pressing protrusion is inserted.

3. The robot cleaner of claim 1, wherein:

the impact sensor is included in a pair of the impact sensors that are positioned to be laterally symmetrical based on a virtual center line that divides the bumper into left and right sides, and each of the impact sensors includes:

a switch lever which receives an impact of the bumper due to movement of the pressing protrusion;

a sensor body which detects the impact of the bumper due to movement of the switch lever; and a rotary roller which is rotatably mounted in an end of the switch lever, wherein the switch lever is positioned obliquely in a backward direction based on the virtual center line.

4. The robot cleaner of claim 3, wherein the curved end surface of the pressing protrusion envelops one side of the rotary roller.

5. The robot cleaner of claim 1, wherein the opening in the bumper through which the protruding boss extends is a bumper guide hole formed in the bumper around the protruding boss to restrict the movement of the bumper by limiting a movement of the protruding boss.

6. The robot cleaner of claim 5, wherein:

the bumper guide hole includes a front bumper guide hole which is positioned on a virtual center line that divides the bumper into left and right sides in a front portion of the bumper, and a pair of rear bumper guider holes which are positioned rearward of the front bumper guide hole and positioned to be laterally symmetrical based on the center line, and the protruding boss includes a plurality of protruding bosses that are received, respectively, in the front bumper guide hole and the rear bumper guider holes.

7. The robot cleaner of claim 1, further comprises a fixing nut which is fastened to the protruding boss without restricting a front, rear, and left-right movement of the bumper.

8. The robot cleaner of claim 1, further comprising:

a first protrusion which protrudes from the main body;

a second protrusion which protrudes from the bumper in parallel with the first protruding member; and a spring which elastically coupled to the first protruding member and the second protruding member, the spring providing an elastic force to separate the first protrusion and the second protrusion.

9. The robot cleaner of claim 1, wherein the bumper includes a housing which forms an external shape, wherein a guide hole restricting a movement of the bumper is formed on an upper surface of the housing, wherein the pressing protrusion extends from a rear surface of the housing.

10. The robot cleaner of claim 1, wherein the bumper includes a housing which forms an external shape, wherein the housing accommodates one or more dust containers which are detachably coupled into a lower side thereof, and one or more agitators which rotate to direct foreign substances on a cleaning surface to the dust containers.

11. The robot cleaner of claim 1, further comprising an auxiliary wheel which is positioned on a lower side of the bumper and spaces the lower side of the bumper from a floor.

12. The robot cleaner of claim 1, further comprising a cliff sensor which is positioned in the bumper to detect a cliff on a floor in a moving area.

13. The robot cleaner of claim 12, wherein the cliff sensor includes at least one light emitter and at least one light detector.

14. The robot cleaner of claim 1, wherein the moving mechanism includes one or more spinning mops.

15. A robot cleaner comprising:

a main body which forms an external shape;

a bumper which protrudes from an outer periphery of the main body and moves when impacting an obstacle;

a pair of the impact sensors that are positioned to be laterally symmetrical based on a virtual center line that divides the bumper into left and right sides, each of the impact sensors being positioned obliquely in the main body; and a pair of pressing protrusions which are coupled to the bumper, and each of the pressing protrusions including a curved end surface which moves to selectively contact one of the impact sensors based on a movement of bumper, wherein the main body is connected to the bumper on a first surface and on a second surface that intersects the first surface, wherein a pair of insertion holes into which the pair of the pressing protrusions are, respectively, inserted is formed on the first surface, and wherein a protruding boss protrudes from the second surface and extends through an opening in the bumper to restrict a movement of the bumper.

16. The robot cleaner of claim 15, wherein each of the impact sensors includes:

a switch lever which receives an impact of the bumper due to movement of the pressing protrusion;

a sensor body which detects the impact of the bumper due to movement of the switch lever; and a rotary roller which is rotatably mounted in an end of the switch lever, wherein the switch lever is positioned obliquely in a backward direction based on the virtual center line.

17. The robot cleaner of claim 15, wherein the pair of the impact sensors detect when a front surface the bumper contacts the obstacle, and one of the impact sensors detects when a corresponding side surface of the bumper contacts the obstacle.

18. The robot cleaner of claim 15, wherein:

the main body includes a cavity to receive the impact sensor, the pressing protrusions protrude from a rear surface of the bumper, and the main body includes an insertion hole through which a portion of the pressing protrusions is inserted to extend into the cavity to contact the impact sensor.

19. A robot cleaner comprising:

a main body which forms an external shape;

a moving mechanism which provides a driving force to move the main body;

a bumper which protrudes from an outer periphery of the main body and moves when impacting an obstacle;

an impact sensor which is positioned obliquely in the main body;

a pressing protrusion which is coupled to the bumper and includes a curved end surface which moves to contact the impact sensor when the bumper moves; and a cliff sensor which is positioned in the bumper to detect a cliff on a floor in a moving area.

* * * * *